United States Patent [19]

Martin et al.

[11] Patent Number: 4,706,565

[45] Date of Patent: Nov. 17, 1987

[54] MULTI-COLOR ENGRAVING SYSTEM

[76] Inventors: John Martin, 10200 W. Bellfort 807-F, Houston, Tex. 77031; Ronald W. White, 21615 Greengate Dr., Spring, Tex. 77388; Johnnie L. White, Jr., 210 Gleneagles Dr., Conroe, Tex. 77385

[21] Appl. No.: 867,042

[22] Filed: May 27, 1986

[51] Int. Cl.[4] ..... B41F 1/00; B41F 1/46

[52] U.S. Cl. ..... 101/151; 101/164; 101/295

[58] Field of Search ..... 101/164, 163, 165, 166, 101/150, 151, 290, 292, 293–295, 316, 317, 318–322, 193, 194, 195, 196, 197, 198, 199

[56] References Cited

U.S. PATENT DOCUMENTS

| | | | |
|---|---|---|---|
| 796,707 | 8/1905 | Clark | 101/293 X |
| 901,517 | 10/1908 | Brooks | 101/166 |
| 1,390,388 | 9/1921 | Robbins | 101/193 |
| 2,620,727 | 12/1952 | Packer et al. | 101/166 X |

*Primary Examiner*—J. Reed Fisher

*Attorney, Agent, or Firm*—Solon B. Kemon

[57] ABSTRACT

A multicolor engraving system includes a plurality of identical engraving presses mounted in line in a common frame. Each press is hydraulically operated and includes a high speed hydraulic motor for reciprocating its shuttle assembly. A work transfer mechanism moves each workpiece sequentially to the presses and accurately aligns it with the die in each press.

8 Claims, 21 Drawing Figures

2.
3.
120
122
28
24
26
22
20
10
118
PAPER TRANSFER DRIVE END
TYPICAL MODULE
PAPER TRANSFER IDLE END 38
114
28
24
26
129
4
20
10
4
24
26
28
129

FIG. 6
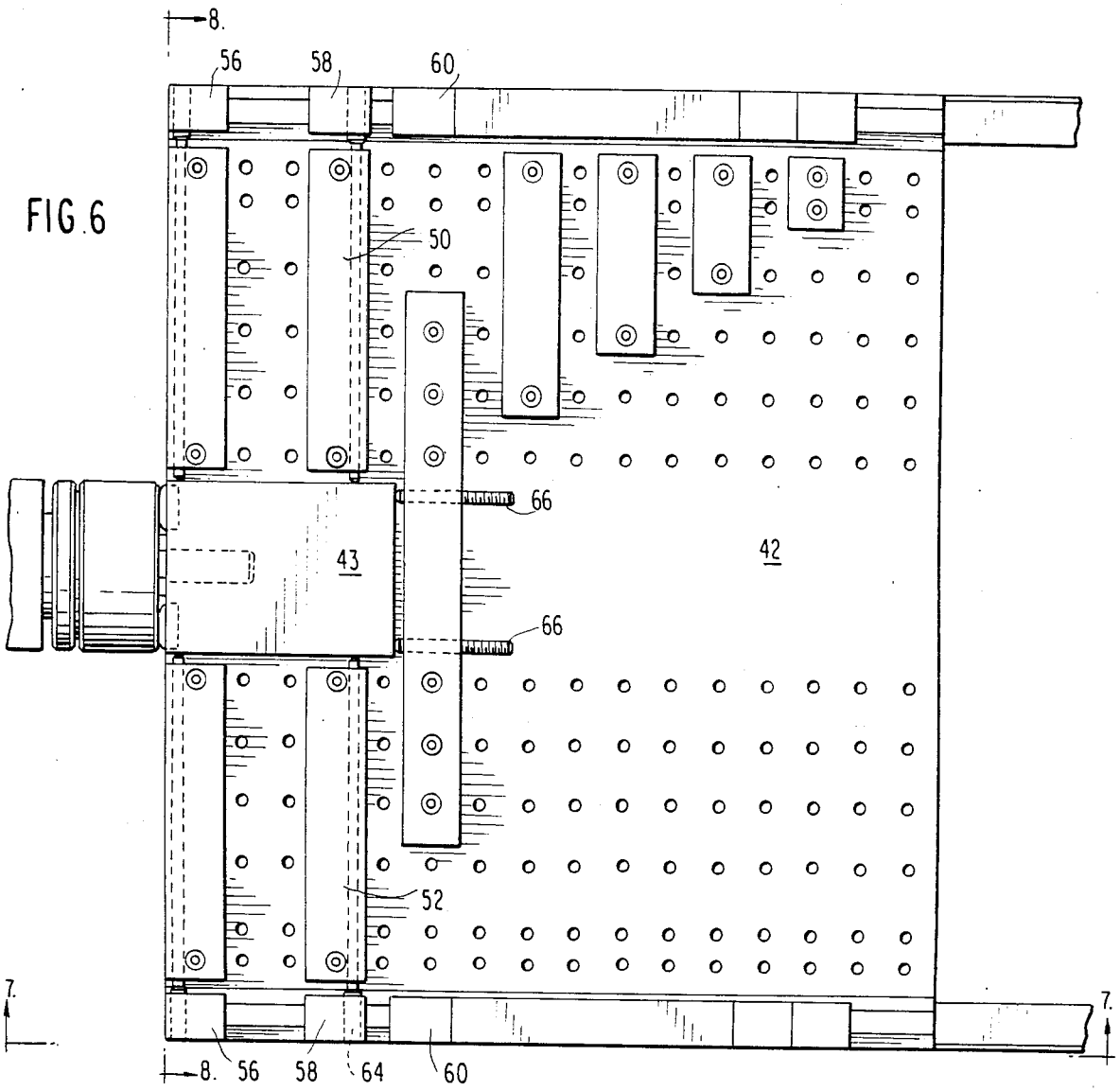
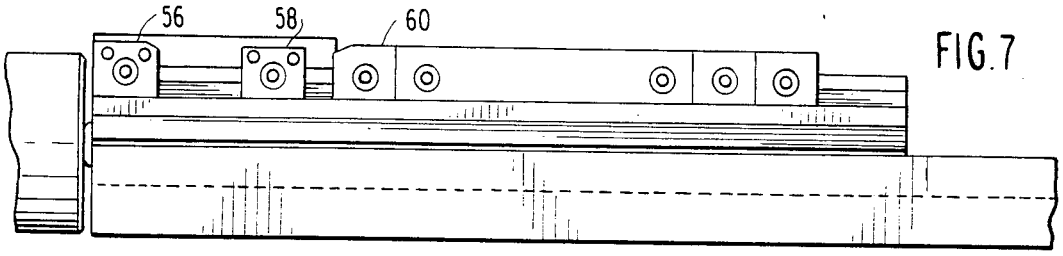
FIG. 7
FIG. 8
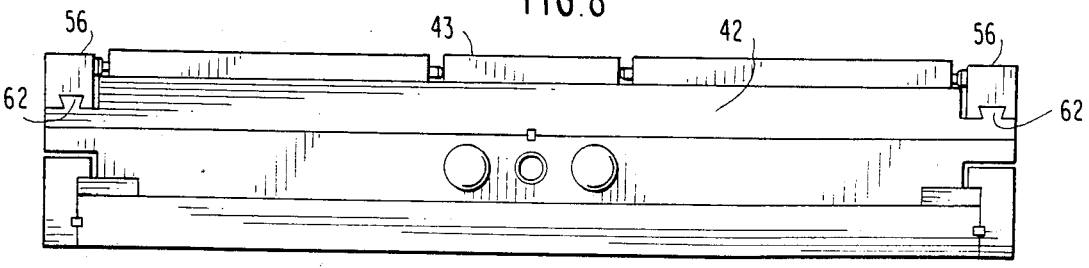

MULTI-COLOR ENGRAVING SYSTEM

BACKGROUND OF THE INVENTION

Engraving presses have undergone little change for many years and typically utilize purely mechanical means to create the force necessary to close the die plate and striker assembly on the work. One such press is shown in U.S. Pat. No. 2,853,942. A more complete history and description of engraving presses may be found "Engraved Stationary Handbook" by Robert N. Steffens, published by the Cronite Company, Inc. of North Bergen, N.J. in 1969 (second edition).

BRIEF SUMMARY OF THE INVENTION

An engraving machine in accordance with the present invention is a modular assembly of two or more, preferably three, identical engraving presses connected together in a line by a common framework. The machine further includes a work transfer arrangement which sequentially moves workpieces from one press to the next and automatically aligns the work pieces with the dies so that each press may engrave in a different color to produce a single multi-color final engraving. Operation of all of the components of each press as well as the work transfer means is by way of hydraulic cylinders and fluid motors.

BRIEF DESCRIPTION OF THE DRAWINGS

FIG. 6 is a top plan view of the die plate slide assembly;

FIG. 7 is a view on the lines 7—7 of FIG. 6;

FIG. 8 is a view on the lines 8—8 of FIG. 6;

DETAILED DESCRIPTION

Figure 1:
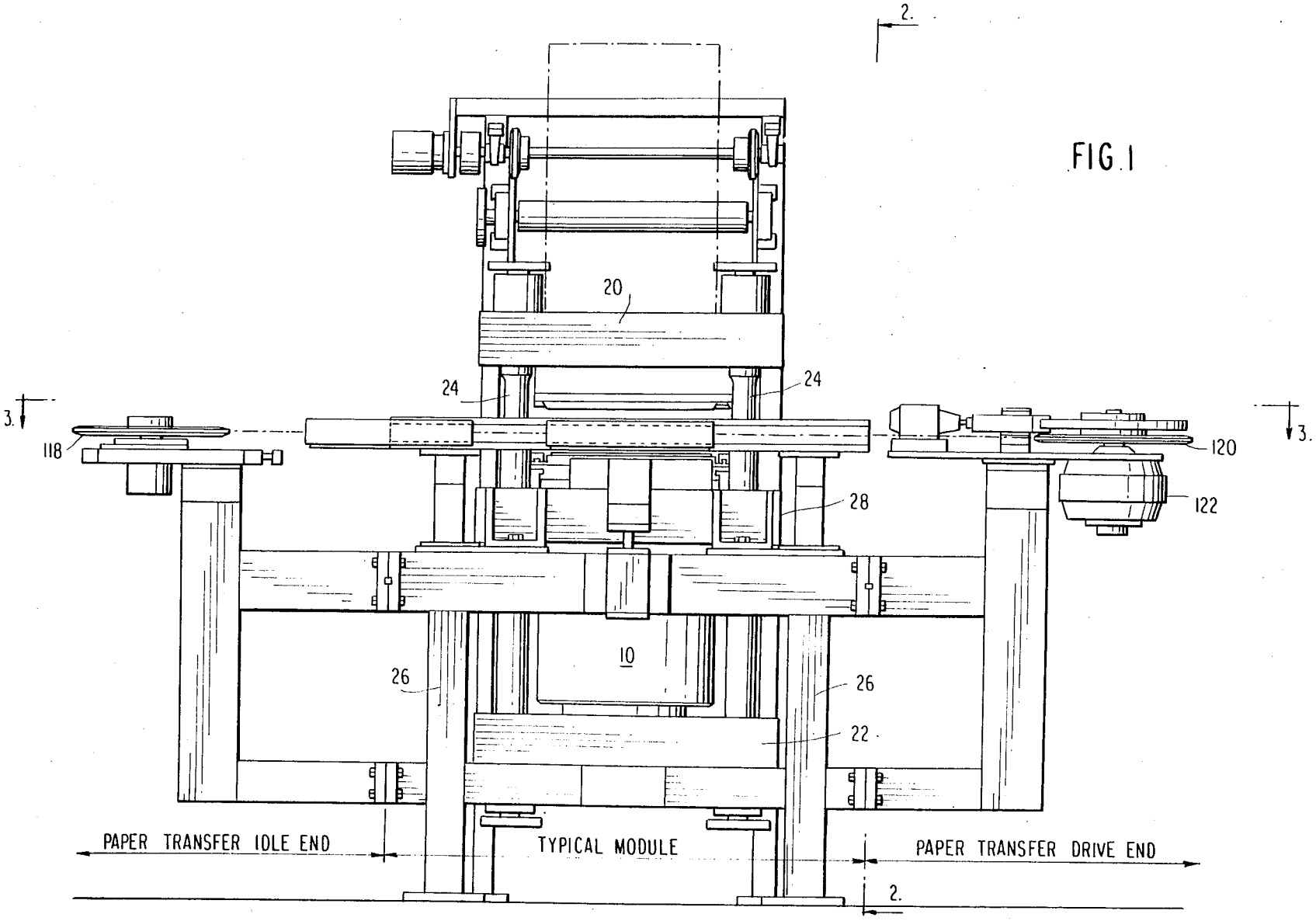
FIG. 1 is a front elevation of a single module and work transfer means.
Figures 2, 18:
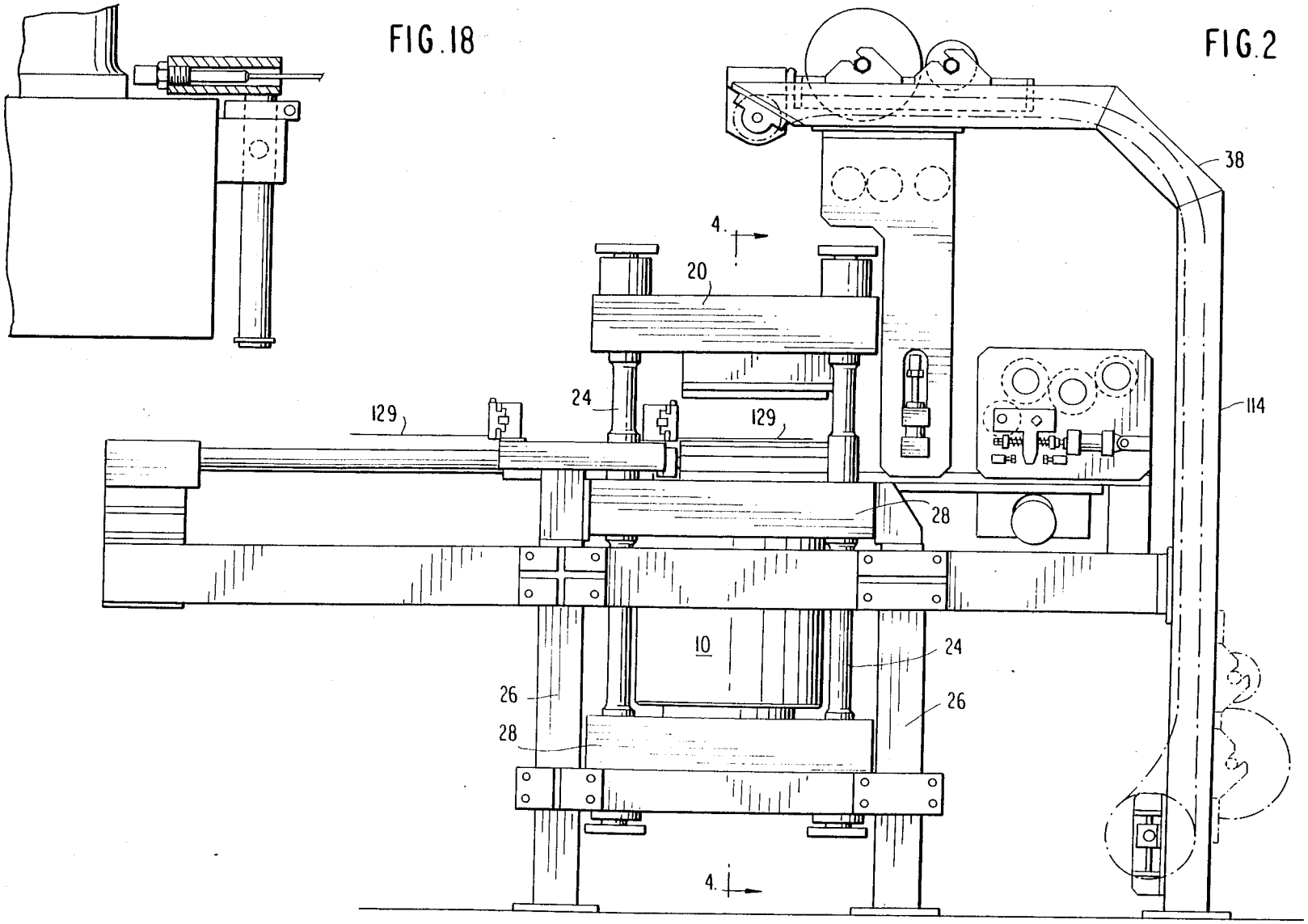
FIG. 2 is an end elevation on the lines 2—2 of FIG. 1.
FIG. 18 is a view partially in section of a press return stroke limiter sensing device.
Figure 3:
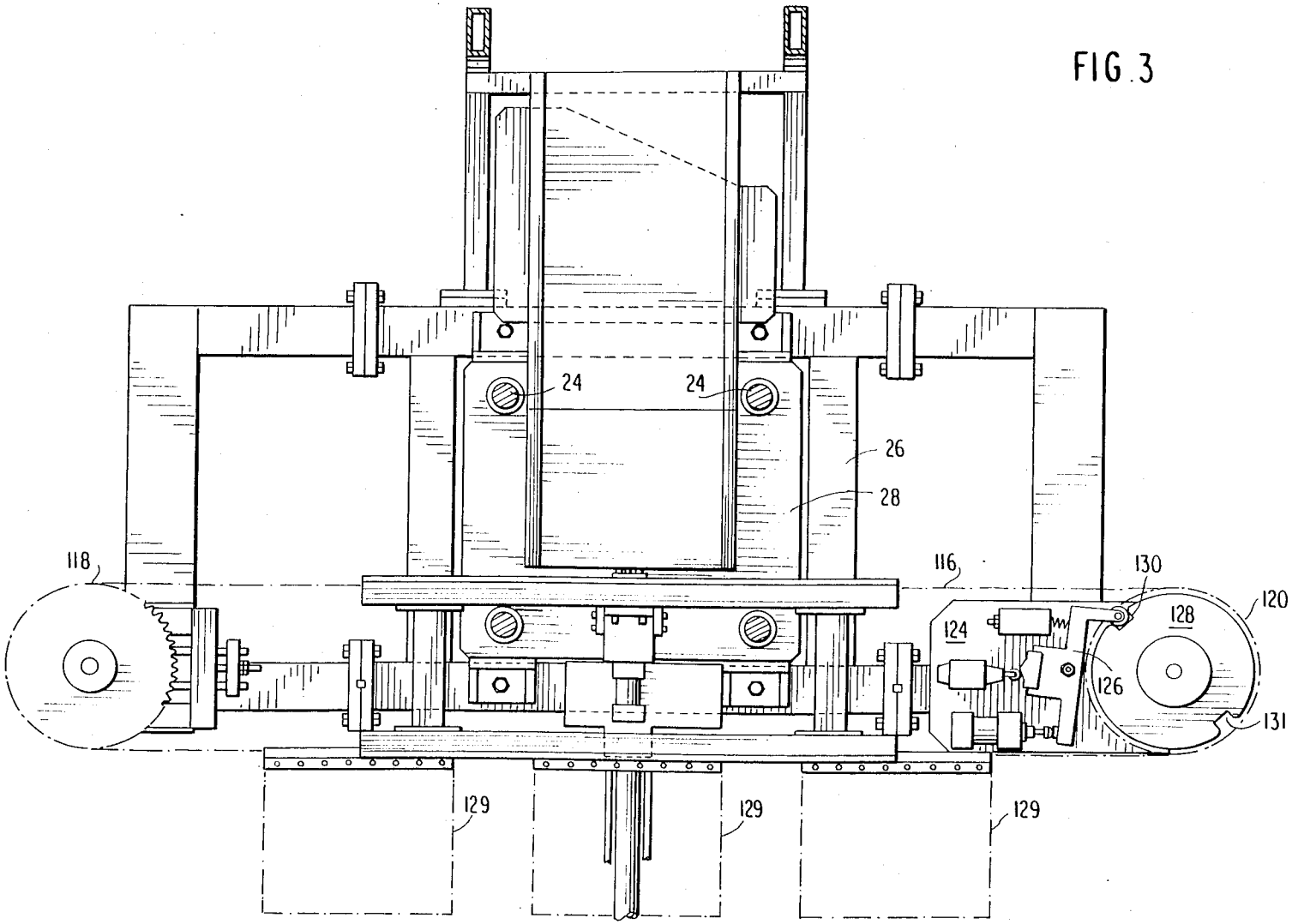
FIG. 3 is a top plan view of FIG. 1.
Figure 4:
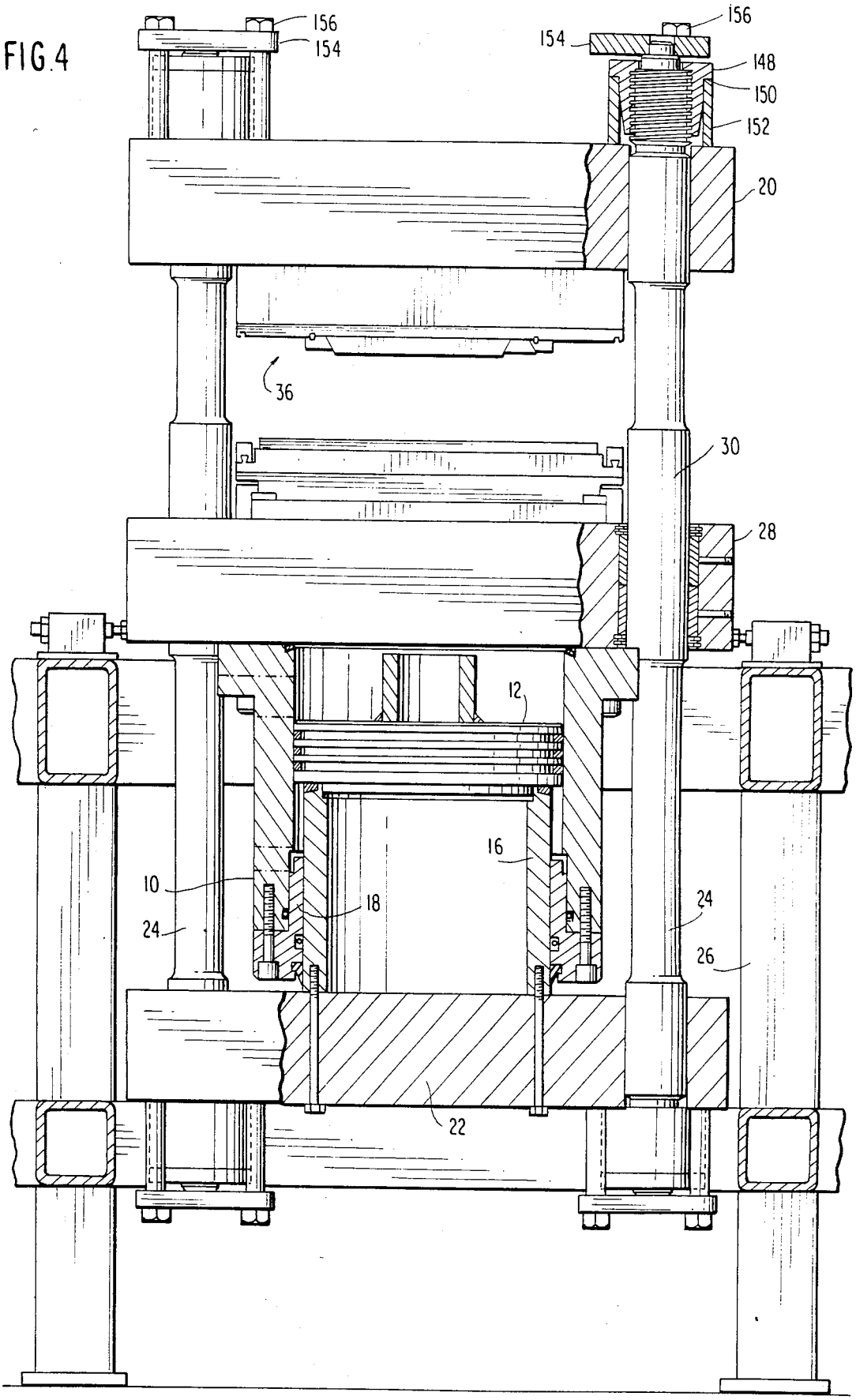
FIG. 4 is a view of a portion of FIG. 2 partially in section.

A general description of the overall machine may be had by referring first to FIGS. 1 to 4 inclusive which illustrate a single module in various views. FIG. 4 which is a sectional view on lines 4—4 of FIG. 2 shows the basic moving parts of a single module. The main hydraulic power cylinder 10 has a plunger assembly 12 which is axially slidable therein and sealed to the clyinder by a series of piston rings 14. A piston rod 16 is secured to the underside of the plunger 12 and slides within a piston rod guide 18 which is removably secured to the inner surface of the main hydraulic cylinder 10.

Upper and lower movable platens 20 and 22 are interconnected by four vertically extending tie rods 24. The lower movable platen is rigidly attached to the piston rod 16 so that pressurization of the main cylinder of the plunger assembly 12 is effective to cause vertical reciprocation of the entire assembly including the upper and lower platens and the tie rods.

As shown perhaps most clearly in the sectional view of FIG. 3, a modular frame 26 supports a stationary platen 28 & the four tie rods extend through the stationary platen at the four corners thereof. The main hydraulic cylinder 10 is rigidly supported from the underside of the stationary platen 28. Each of the tie rods include a bearing section 30 which is received within bearing members 32 supported in the stationary platen 28. A die plate 34 is slidably mounted on the upper surface of the stationary platen 28 for reciprocation between inking, wiping and printing positions as will be fully described hereinafter. The upper movable platen 20 supports a conventional striker assembly 36.

As shown in the end view of FIG. 2, each module in addition to the pressing components previously described, also includes a wiper arrangement for wiping excess ink off of the dies as is conventional in the engraving art. The wiper assembly is shown generally at 38 in FIG. 2 and the inking assembly at 40. both of these assemblies will be more fully described hereinafter but FIG. 2 shows the general arrangement.

Figure 5:
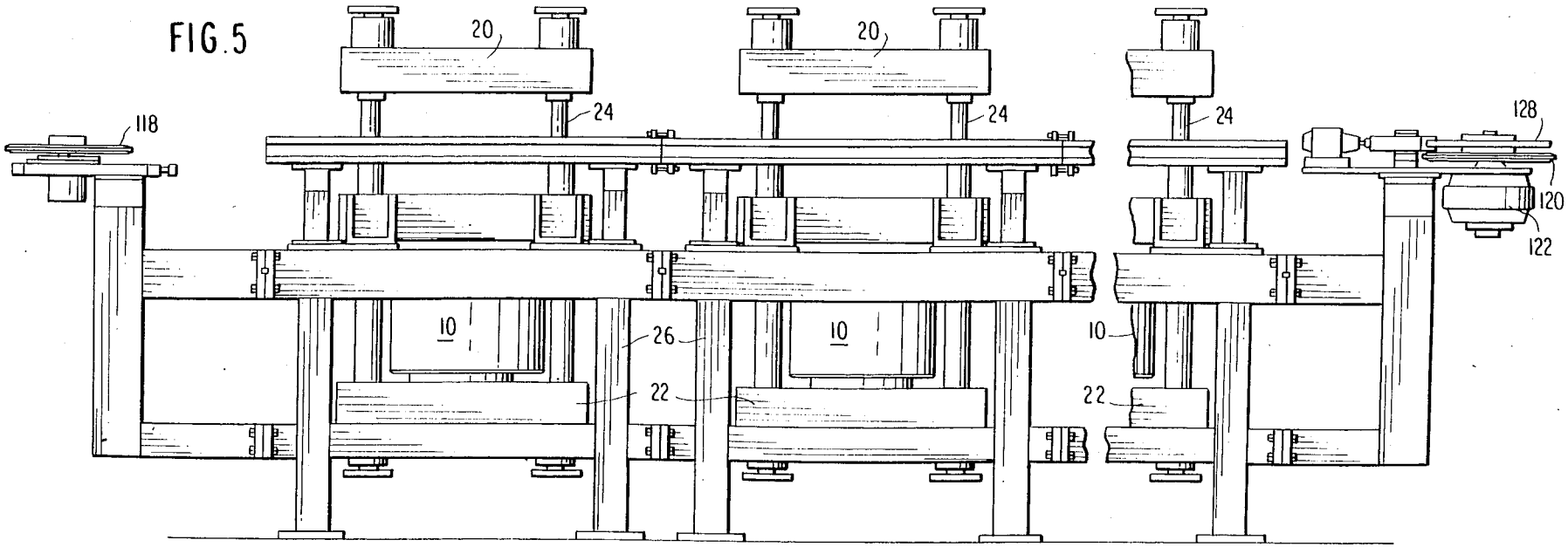
FIG. 5 is a view showing an inline assembly of three of the modular units of FIG. 1.
Figure 10:
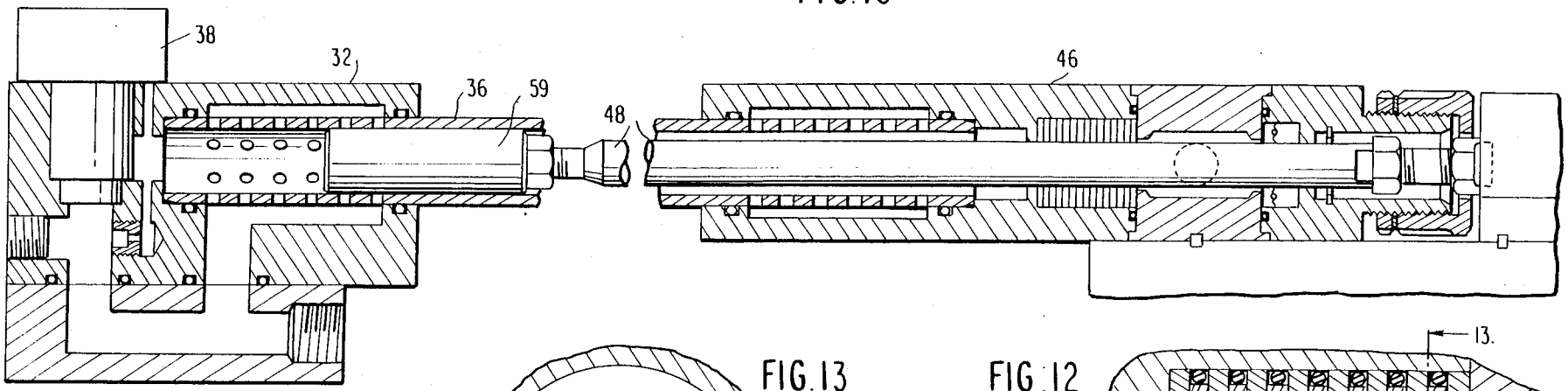
FIG. 10 is a detailed sectional view of the linear fluid motor of FIG. 9.
Figure 12:
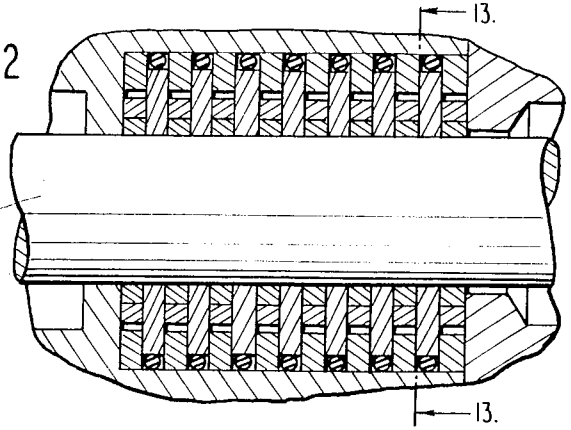
FIG. 12 is an enlarged sectional view of a portion of FIG. 10.
Figure 13:
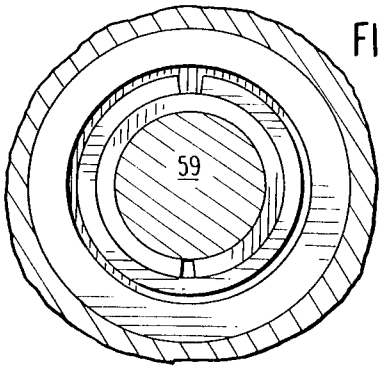
FIG. 13 is a section on the lines 13—13 of FIG. 12.

FIG. 5 is a partial cut elevation showing an assembly of three of the modular units of FIGS. 1 to 4 assembled in an inline relationship.

The opening between the die plate assembly and the striker as shown, for example, in FIGS. 2 and 4 is much greater than it will be during operation of the press and is shown in these Figures merely for clarity of illustration. When the press is running the clearance is only of the order of 10 to 15 mm, just enough to clear the work transfer. For set-up purposes, however, the opening can be increased to something of the order of 100 mm to allow working with the die plate and striker.

THE DIE PLATE ASEMBLY AND FLUID MOTOR FOR MOVING IT BETWEEN THREE OPERATIVE POSITIONS

The die plate slide 42 is shown in top plan view of FIG. 6 is carried by a shuttle 44 shown in the end view of FIG. 8. The slide and shuttle both slide over the shuttle base 46 which in turn is fastened to the upper surface of the stationary platen 28. As shown in FIG. 6, a die plate 48 is rigidly clamped to the upper surface of the slide 42. Clamping plates 50 of various sizes are positionable at a plurality of locations on the upper surface of the slide depending on the size of the die plate being used. Clamping plates include bores 52, housing rods 54 to contact and adjust the position of the die plate. A series of cams 56, 58 and 60 are adjustably positioned along the side of the slide on dove tail ways 62. These cams cooperate with the inking means to be described hereinafter. Cams 56 and 58 are shown in FIGS. 6, 7 and 8 include set screws 64 to position the rods 54 for positioning the die plate transversely of the slide. A further clamping plate 64 has a pair of set screws 66 for clamping the front edge of the die plate.

Figure 9:
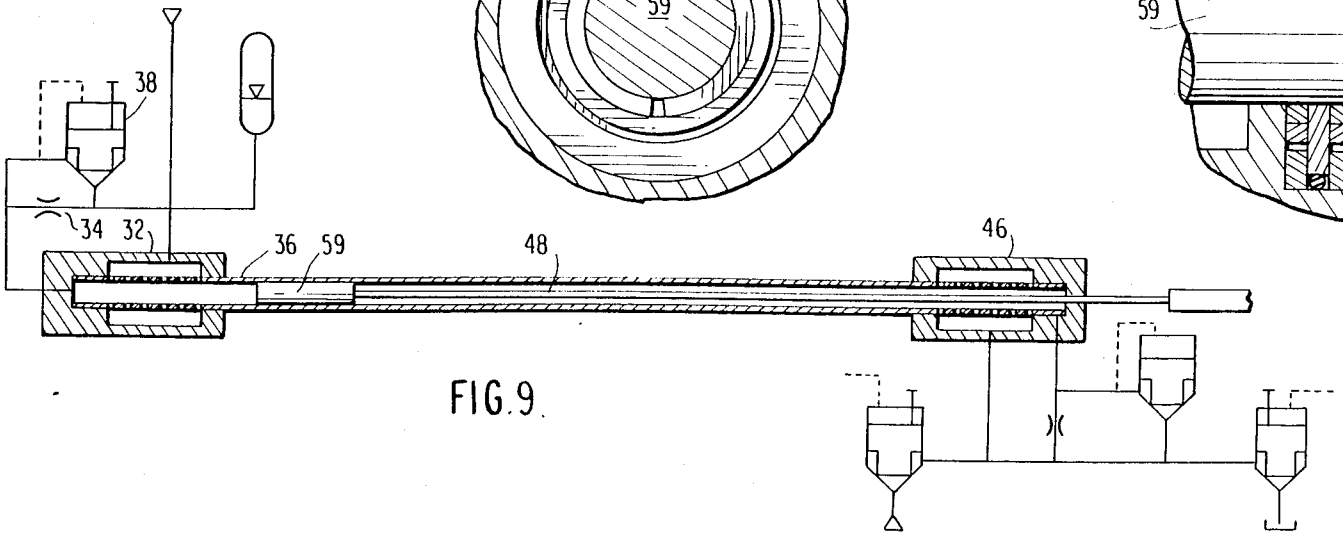
FIG. 9 is a diagrammatic showing of the fluid operated means for reciprocating die plate assembly between printing, inking and wiping positions.
Figure 11:
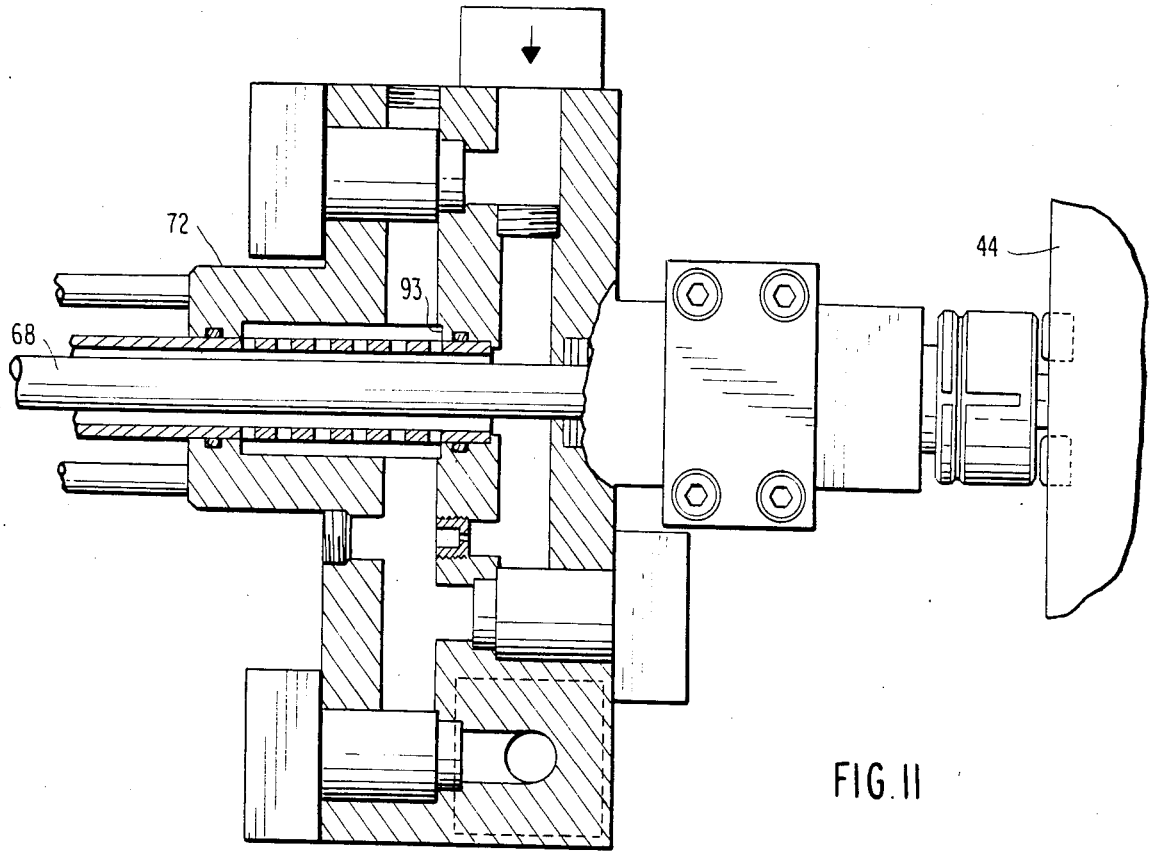
FIG. 11 is a view partially in section on the lines 11—11 of FIG. 10.

Referring now to FIG. 9. which is a diagrammatic showing of a high speed linear motor used to reciprocate the entire die plate assembly of FIGS. 6 to 8, the shuttle 44 is shown connected to the piston rod 68 of the linear motor. An elongated cylinder 70 extends between head and tail blocks 72 and 74 respectively and housing the piston 66 and the piston rod 68. Each end of the clyinder has a series of radial openings 78 placing each of the cylinder ends in communication with its respective cylinder block cavity. The head end is always connected to a low pressure source 80 which will move the piston and the entire shuttle assembly to the right in the absence of resistance due to positive pressure on the rod end of the piston. A high pressure source 80 acting on the annular surface defined by the rod and piston will move the piston to the left against the biasing force of the lower pressure on the left end of the piston.

Operation of the motor is basically controlled by the valving arrangement at the head or high pressure end. A logic valve 82 when closed and logic valve 84 opened, permits the piston to travel to the right and the fluid moved by the rod end of the piston will flow through the radial openings 78, the lines 86 and 88 and the opened valve 84 to the reservoir 90. Movement will continue at a oonstant speed determined by the flow rate in this path until the piston begins to cover up the radial openings, creating a back pressure, which slows the rate of travel until all of the openings are covered which almost stops the movement completely. The piston continues to creep however, due to flow through the fixed orifice 92 and finally stops when the piston assembly contacts a shoulder 93 in the head 72. This permits the self piloting valve 94 to open and when the logic valve 82 controlling the high pressure source opens and the discharge valve 84 closes, high pressure can reach the right hand end of the piston initially through line 88, the fixed orifice 82, and valve 94. This starts the piston moving to the left and as it uncovers the radial ports 78, high pressure continues moving it to the left until it begins to cover ports at the left end of the cylinder at which time the deceleration and stopping cycle which occurred at the opposite end is repeated, due to the gradual covering of ports 78 at the tail 74 end and finally through the braking effect of fluid flow through the fixed orifice 96 which closes the self piloting valve 981 limiting further fluid flow to the accumulator 100 to that through the orifice 92. The accumulator 100 is mkaintained at the pressure of the low pressure source in order to start the return stroke of piston once the valve 82 has closed, isolating the high pressure source and valve 84 has opened to connect the cavity of cylinder head 72 to the reservoir 90.

DIE INKER AND WIPER

Figure 17:
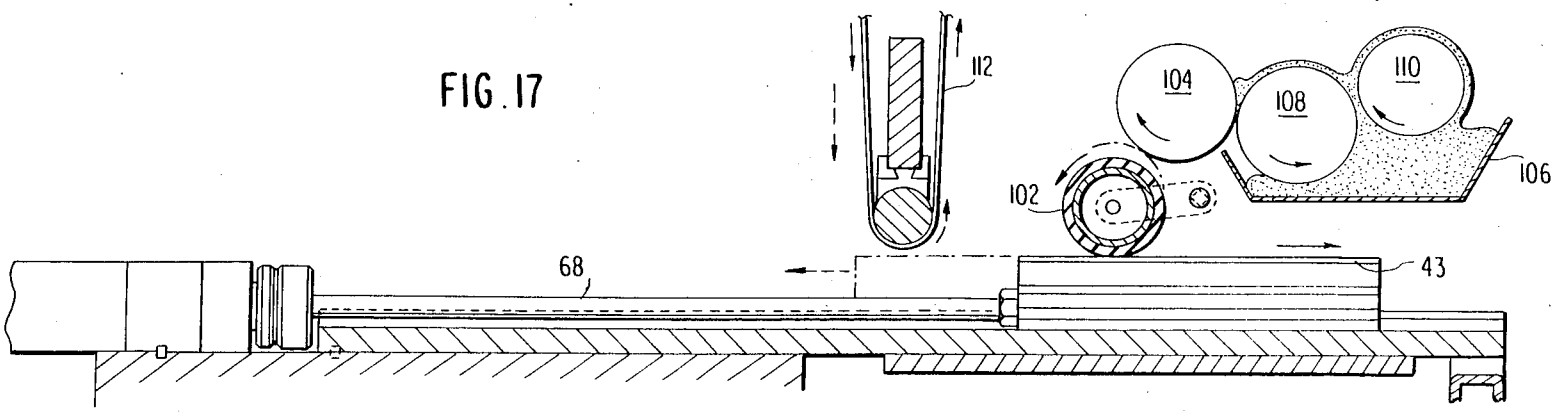
FIG. 17 is a side view with parts broken away and partially in section showing the die plate, the inker and the wiper with the die plate in inking position.

Referring now to FIG. 17, the die plate 48 carried by the shuttle assembly is nearing the end of its forward stroke during the inking cycle. The inking roller 102 which alternates between the position shown here in contact with the die plate and the indicated dotted line position where it contacts the roll 104 and is coated with ink picked up from the resevoir 106 by rolls 108 and 110. Opposite ends of the inking roll shaft have roller cam followers which engage the upper surfaces of cam 56, 58 and 60. These cams are for the purpose of allowing contact between the downwardly biased inking roll 102 and the die plate 48 only in those areas where engraving exists. For example, if a letterhead is being engraved with printing at the top and bottom of the page, the cams can be arranged to limit the contact of the roller with the engraved portions of the die and thus reduce the amount of ink loss during the wiping cycle. The rolls 104, 108 and 110 are continuously driven from a fluid motor and belt drive not shown.

As the die plate is returned to the left in FIG. 17, the inking roller is raised to the dotted line position shown and the die plate then contacts the wiping strip 112 which removes all ink from the surface of the die plate leaving only the engraved depressions in the die plate filled with ink. The die plate is then ready to be positioned beneath the striker assembly.

As shown in FIG. 2, the wiper assembly 38 is positioned at the rear of each module and includes a stand 114 for loading fresh rolls of wiper paper and transporting them to operating positions at the top of the stand.

WORK TRANSFER APPARATUS

As shown on the top plan view of FIG. 3 and the front elevation of FIG. 1, an endless work transfer chain engages a pair of sprockets 118 and 120. The former is an idler while the latter is positively driven by a fluid motor 122. An escapement mechanism 124 shown in FIG. 3 includes a pivoting detent 126 which cooperates with a wheel 128 having cut outs 130 and 131 which are 180° apart. The wheel 128 is rigidly attached to the drive sprocket 120 and therefore, permits indexing action of the chain 116.

FIG. 5 which shows three of the basic modular units assembled to each other in a line also shows the position of the various components of the work transfer means which they would normally occupy in order to transfer work successively to the three aligned presses. In the end view of FIG. 2, one work piece 129 is shown positioned over the die plate in position to be printed while another is out in front of the press on the front flight of the drive chain 116. The position of the work pieces on the front flight of the drive train is also shown in dotted line in the top plan view of FIG. 3.

Figure 14:
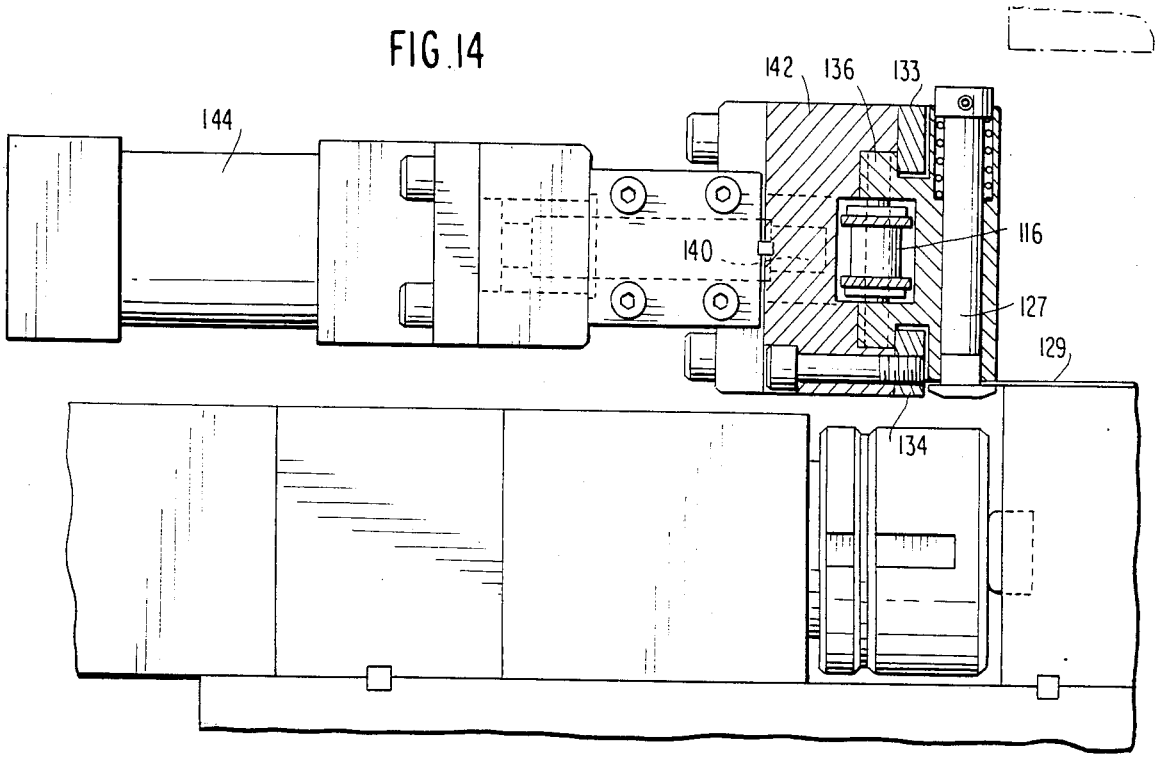
FIG. 14 is a vertical partially sectioned view of the paper clamping and transporting apparatus.
Figure 15:
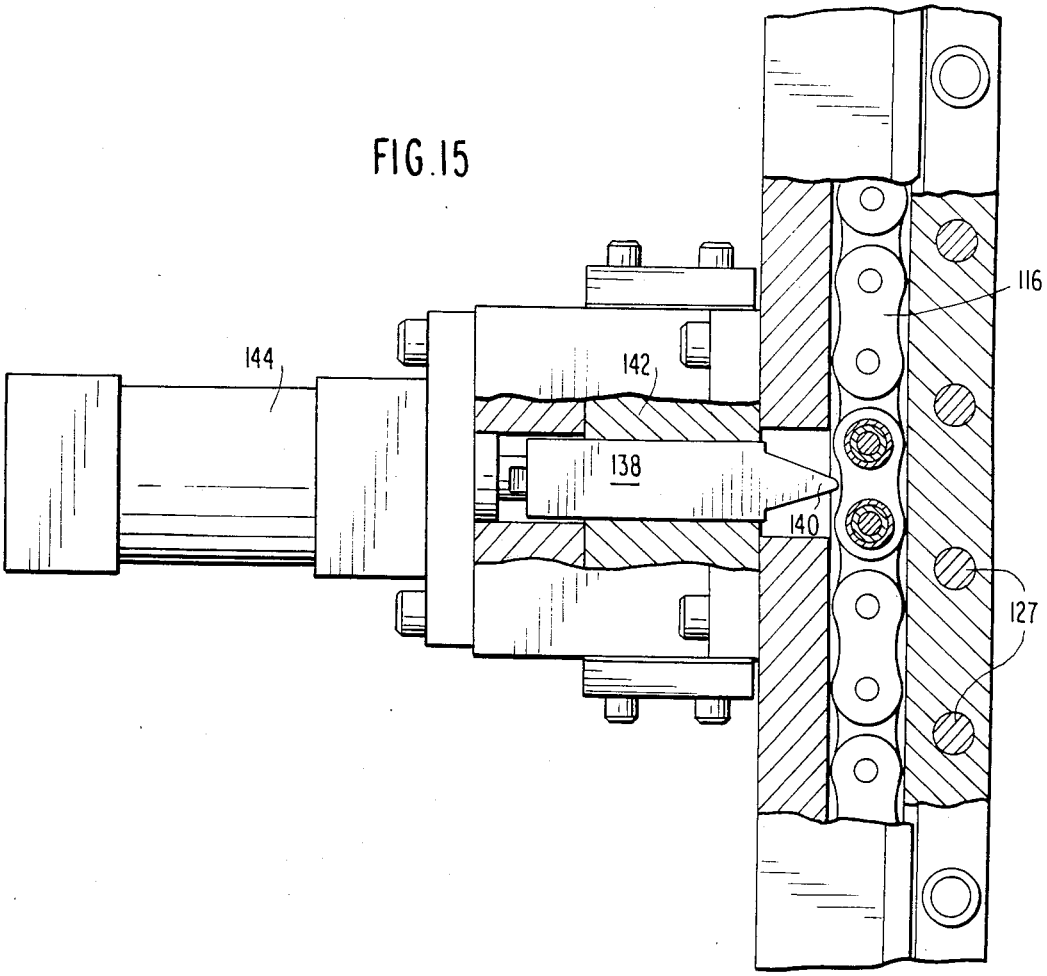
FIG. 15 is a top plan partially in section of the paper clamp aligner.

Referring now to FIGS. 14 and 15, one of the work holding clamp bodies carried by the chain 116 is shown partially in section. Each clamp assembly includes a vertical bore housing a pin 127 urged upwardly by a coaxial spring. The pin 128 terminates at its lower end in an enlarged head 135 which clamps the edge of the work between it and the body 127. The clamp rides on upper and lower guide rails 133 and 134 and are connected to the chain by pins 136.

Since successful multicolor printing is dependent upon highly accurate positioning of the work pieces over the dies in each press module, some means for accurately locating the chain 116 at each module is required. FIGS. 14 and 15 show plunger 138 having tapered end 140 slidably mounted in block 142 which is rigidly secured to the upper and lower guide rails. A linear fluid motor 144, when actuated, drives the tapered end of the plunger between adjacent rollers of the chain 116 to fix the position of the chain and thus the work piece carried thereby with an accuracy of 0.001 mm. measured at the ends of the clamps 127.

Figure 16:
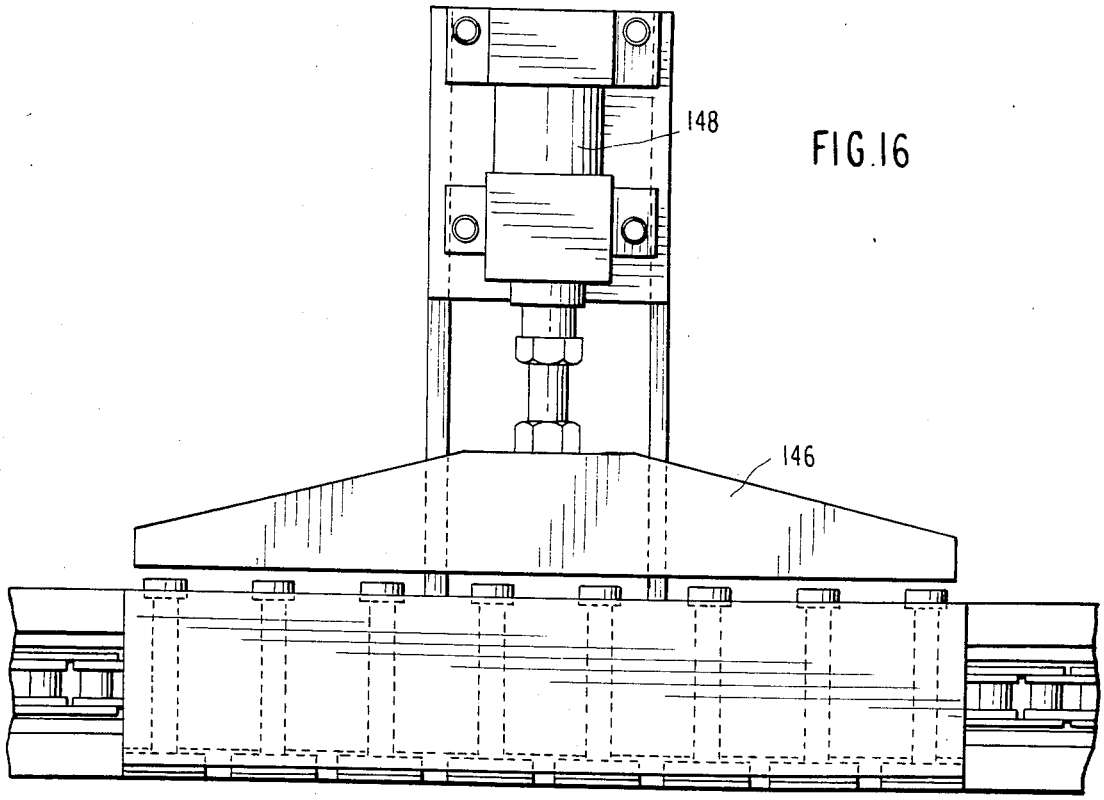
FIG. 16 is a view of the paper clamp release arrangement.

After a work piece has been engraved in back of the modules, it is released from the chain clamps by an unloader device shown in FIG. 16. This is merely a block 146 moved downwardly by a linear fluid motor 148 to simultaneously engage a plurality of the clamping pins 128 and press them against the force of their biasing springs to release the work pieces for handling by an unloader not shown.

Figure 19:
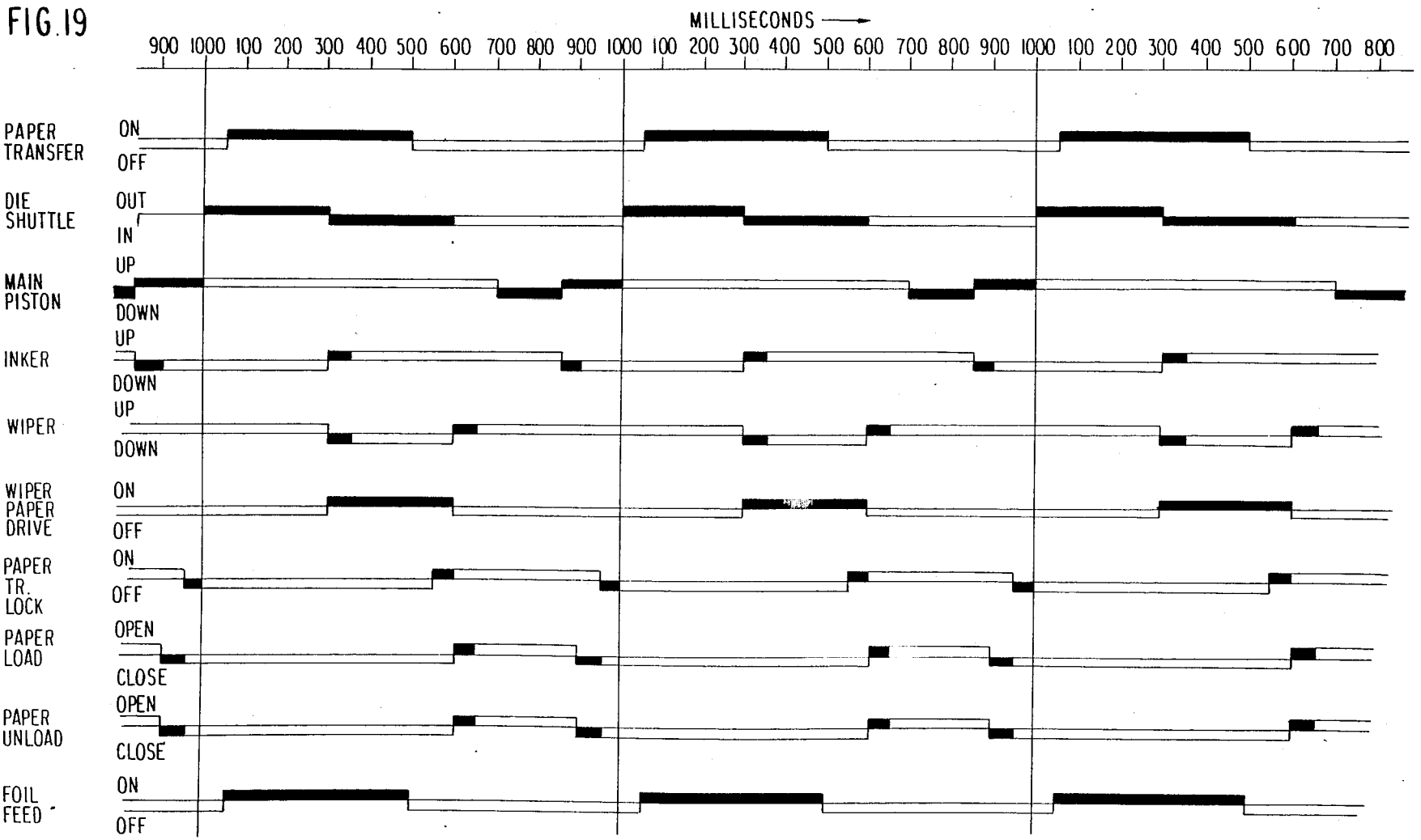
FIG. 19 is a cycle diagram.

The time diagram of FIG. 19 is useful to explain a complete operating cycle of all of the various parts of each module hereinfore described. The Figures at the top of the diagram are milliseconds increasing from left to right. In the left hand column adjacent the 0 or 1000 milliseconds vertical line, are listed the various components of the machine and opposite each in a horizontal graph of the operation of that component as related to the operation of the other components and to the common time base shown at the top.

Starting at the left hand vertical line corresponding to 0 or 1000 milliseconds, the work transfer is off, the die shuttle is in, corresponding to the printing station, the main piston is up spacing the striker above the already printed paper, the inker is down and prepared to receive the incoming die plate for inking, the wiper is up to allow free passage of the die shuttle, the wiper paper drive is off with no movement of the wiper paper, the paper transfer lock is on its way to off, the paper load clamp is closed, the paper unloader claimp is closed and the foil feed, if any is off.

Starting a cycle, the die shuttle starts toward the inking station at 0 milliseconds and must reach the end of its stroke and the inking operation at 300 milliseconds where it is instantly reversed to be back in the printing station at 600 milliseconds.

At the instant the die shuttle starts to return, the inker goes up to 300 milliseconds and will start to recoat the inker roller with fresh ink at 350 milliseconds and keeps on recoating until 850 milliseconds where it prepares again for the next inking cycle. At the same time the inker retracts 700 milliseconds, the wiper is lowered and must be positioned at the wiping position at 350 milliseconds and stay in this position until the end of the wiping cycle and the die plate return at 600 milliseconds. The wiper paper drive starts to drag the wiper paper at 300 milliseconds and stops at 600 milliseconds.

The paper transfer stops at 500 milliseconds and at 550 milliseconds the paper transfer lock enters and holds until 950 milliseconds.

The paper loader and paper unloader open the paper clamps at 600 milliseconds and close at or before 900 milliseconds.

The main piston starts down at 700 milliseconds and starts it uptravel at 850 milliseconds where it will stay until the next cycle.

TIE ROD ASSEMBLY AND REPLACEMENT

The tie rods of the modular press of this invention can be easily replaced without tearing down the entire press. Referring to FIG. 4, the manner of connection of the tie rods to the upper movable platen is illustrated and it will be appreciated that the identical connection exists at the lower end of each tie rod where they are connected to the lower movable platen. Each tie rod 24 is threaded at its opposite ends to receive a nut 148 having a platen facing shoulder 150 which engages a spacer ring 152. The spacer 152 can be lengthed by the use of shims or shortened by simple machining in order to adjust the necessary position of the platen with respect to the end of the tie rod. A plate member 154 overlies the nut and spacer assembly and is secured to the platen 20 by means of three equally spaced studs 156, one of which is shown in the upper right hand corner of FIG. 4.

In the event of breakage of the tie rod, it can obviously be easily removed simply by removing the studs 156 and the nuts 148 at each rod. The broken pieces may be withdrawn through the fixed and movable platens and a new one inserted in its place with no further removal of parts from the press proper.

Figure 20:
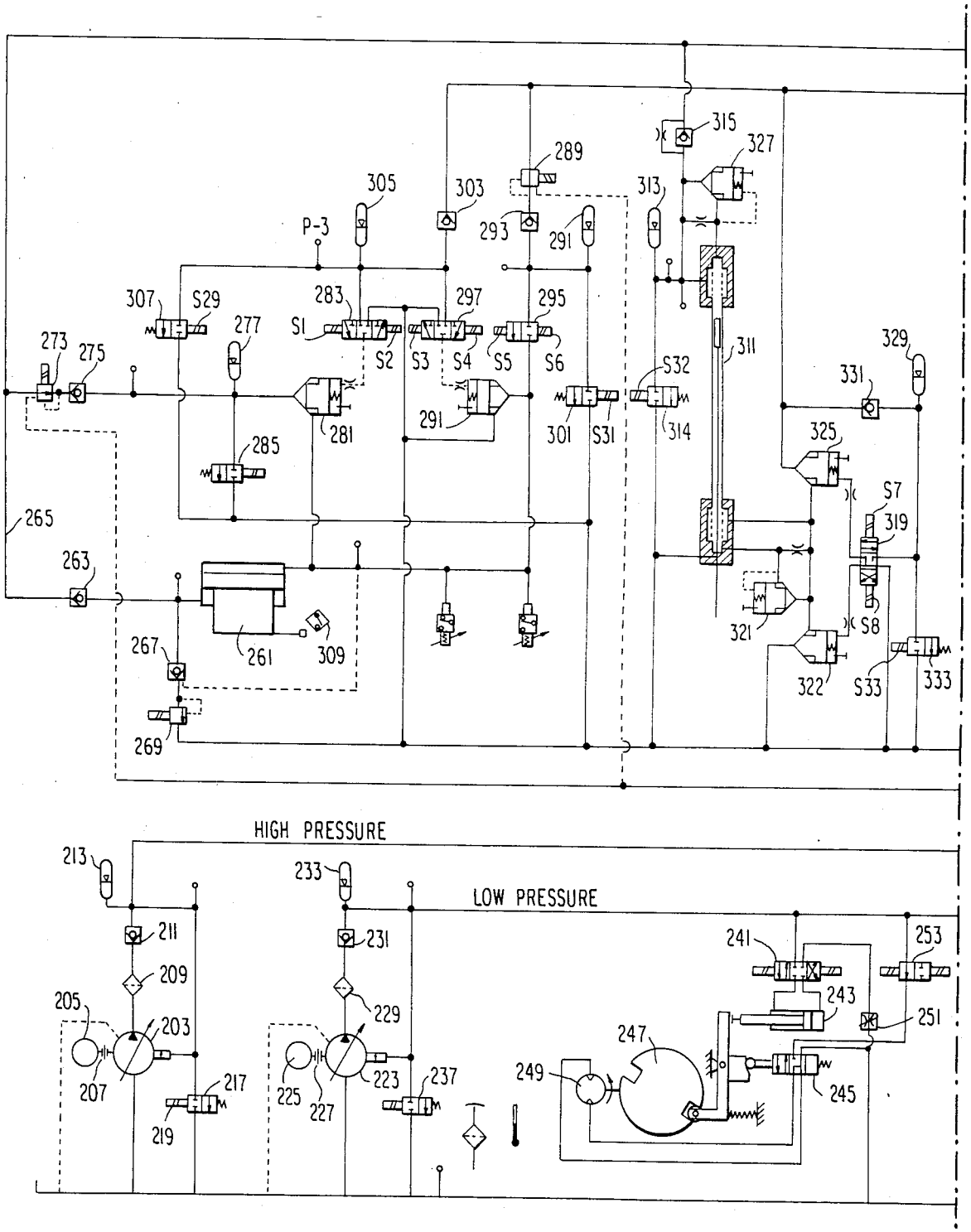
FIGS. 20 and 21 are a fluid power operational diagram.
Figure 21:
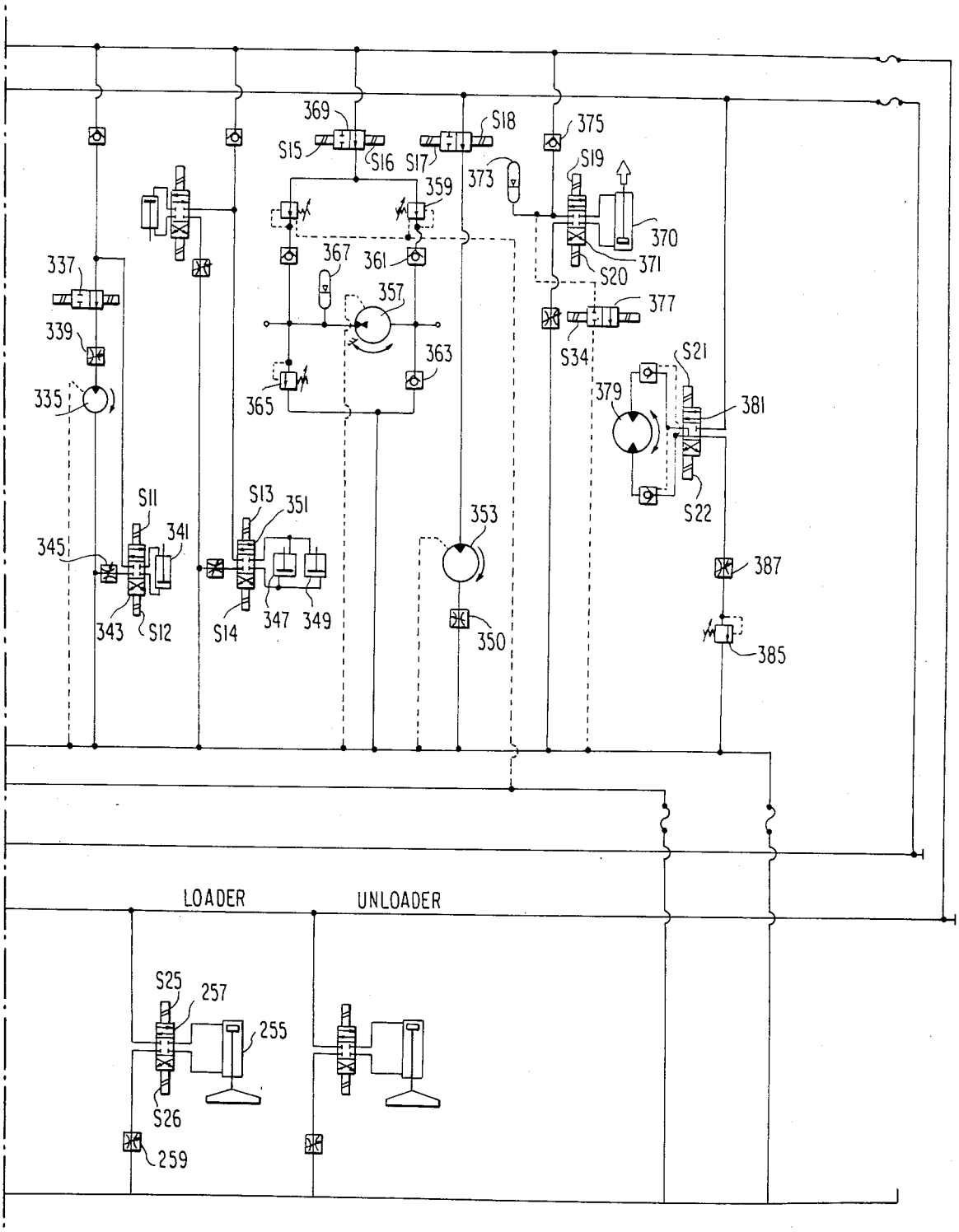

Referring now to FIGS. 20 and 21, the fluid power operating system, shown at the lower half of these sheets is common to all of the individual presses, regardless of the number. The upper half of the fluid power diagram corresponds to only one press. For convenience in describing these figures, reference numerals beginning with 203 and following in order have been used regardless of numerals assigned to parts in the earlier figures.

The central hydraulic power station is a modular dual pumping station, sharing a common reservoir.

A high pressure variable volume, positive displacement pump 203 driven by an electric motor 205 through a flexible coupling 207 delivers the fluid through a pressure filter 209, and an unidirectional (check) safety valve 211 to the high pressure circuit and the high pressure accumulator 213. The pressure setting is verified by the remote pressure sensor.

The accumulator depressurizing safety valve 217 is tied to the main operating circuit. The de-energization of the main circuit, will also de-energize the solenoid 219 of the safety valve 217 that allows the spring off-set directional valve to discharge the pressurized fluid into the tank 221. This safety feature is carried throughout the whole fluid power circuit, rendering the machine safer for maintenance.

The low pressure variable volume, positive displacement pump 223 driven by an electric motor 225 through a flexible coupling 227, delivers the fluid through a pressure filter 229, and unidirectional (check) valve 231 to the low pressure circuit and accululator 233.

The pressure setting is verified by the remote pressure sensor.

The accumulator and circuit depressurizing safety valve 237 is integrated into the machine control circuit. The interruption of the control circuit also disconnects the spring off-set safety valve discharging the pressurized fluid to the tank.

A momentary energization of the directional flow control valve 241, extends the lineal fluid motor 243 (cylinder) which in turn operates the directional flow control valve 245 through the rocker arm cam releasing the cam plate 247, and energize the fluid motor 249.

As soon as the cam follower has cleared the slot on the cam plate, the directional flow control valve 241 is reversed with signal S-27, which in turn retracts the lineal fluid motor 243. The cam follower is now riding on the periphery of the cam plate 247, until it falls into the cam slot, urged by the bias spring of the rocker arm.

At the moment the cam follower falls into the slot of the cam plate, the rocker arm cam repositions the directional fluid control valve 245, interrupting the supply of pressurized fluid, and short circuiting the fluid motor ports with the exhaust port, leaving the rotary motor 249 in neutral (free wheeling).

The rotational speed of the rotary fluid motor is regulated with the flow control valve 251 in the exhaust line of the directional flow control valve 241.

The safety shut off valve 253 is closed only for maintenance purposes.

The lineal fluid motor 255, operated by the directional flow control valve 257 is extended with the signal S-25, and retracted with the signal S-26. The paper transfer clamp is opened by depressing the individual clamp members. By retracting the plunger of loader lineal fluid motor 255, the individual paper clamps close by spring action, and pinch the sheet of paper between the individual clamp lips and the clamp body. The operating speed of the motor 255 is regulated with the flow restriction valve 259.

The unloader operation is identical to the operation of the loader, except that in the case of loader the paper is fed in, and in the case of unloader, the printed sheet of paper is dropped out.

The main ram 261 annular area is permanently pressurized, through the unidirectional (check) valve 263, to the low pressure fluid supply line 265, and is exhausted through a pilot operated check valve 267, and remotely controlled counter balance valve 269, to the operation drain line, and finally to the tank 221.

A low pressure fluid, pre-regulated by the remote controlled pressure reducing valve 273, is charged through the check valve 275, to the low pressure accumulator 277. The main ram 261 is lowered with a regulated low pressure fluid through the logic valve 281, by exhausting the high pressure pilot pressure with the signal S-2 of the directional control valve 283.

During the normal working cycle of reduced travel of the main ram 261, the low pressure pre-fill fluid is supplied by the accumulator 277, and the fluid flow and consequently the lowering speed of the ram 261 is regulated by the internal restriction of the flow path of the logic valve 281.

The accumulator 277 safety unloading valve 285, signal is tied to the main control circuit, that at the shut-down, automatically unloads the accumulator.

The main ram pressure will suddenly rise to the preset value. At the moment the ram makes contact with the die plate, no more fluid is required above the ram. Immediately upon a signal closing the pilot valve 283 this pressurizes the pilot chamber of the logic valve 281, interrupting the low pressure fluid connection to the ram.

The high presure fluid, regulated by the valve 289 and stored in the accumulator 291, is isolated from the circuit pressure fluctuations by check valve 293.

A signal S-5 on valve 295 conducts the pre-regulated and stored fluid to enter to the main ram cylinder, and apply the final pressure to accomplish the ink transfer between the engraved die and the paper.

The actual demand of the high pressure fluid is limited only to compress the fluid from previous low pressure level to a nwe high pressure level, and provide the additional volume required to compensate for the expansion of the cylinder, tubing, and the stretch of the press structure.

After a pre-determined high pressure ON time delay the press cycle is reversed, where the signal S-6 of valve 295 interrupts the high pressure fluid supply, signal S-1 of valve 283 maintains the low pressure logic valve 281 closed, and signal S-3 of valve 297 exhausts the pilot pressure of logic valve 291, allowing the fluid above the ram to exhaust to the operation drain, and finally return to the tank 221.

The accumulator 299 safety unloading valve 301 signal S-31 is tied to the main control circuit, that at the shut-down, automatically unloads the accululator.

The pilot valves 283 and 297 of high pressure supply, are isolated from the circuit pressure fluctuation as with a check valve 303, high pressure accumulator 305 and remote pressure reading point P-3.

The high pressure accumulator 305 safety unloading valve 307 signal S-29 is tied to the main control circuit, that at the shut-down, automatically unloads the accumulator.

The fluid above the ram is pushed through the logic valve 291 to tank 221 by the low pressure fluid acting upon the annular area of the ram 14. The rising ram triggers a proximity switch 309, a signal from which will arrest the travel of the ram 14 with a signal S-4 of valve 297 that closes the logic exhaust valve 291, opening the press only far enough to make the paper transfer. This reduces the requirements of the operating fluid, which translates to economy in power consumption, and an increased operating speed.

The shuttle plunger in cylinder 311 is constantly pressurized by the low pressure fluid, stored in the accumulator 313, through the check valve 315, with a pressure equalizing capillary orifice.

The accumulator 313 safety unloading valve 314, signal S-32 is tied to the main control circuit, that shut down, automatically unloads the accumulator.

At the end of the cylinder 311, the signal S-7 of valve 319 exhausts the logic valve 321 pilot pressure, opening the valve and allowing the cylinder 33 to exhaust the annular volume of rod end, propelled by the low pressure fluid acting upon the plunger.

The annular volume of fluid is discharged through the openings in the cylinder wall, until the plunger gradually covers all of the holes. The remaining annular fluid returning to tank 221 creates momentary pressure increase in the line due to the fixed restriction in the return line. This momentary pressure increase closes the logic valve 321, leaving the only available return flow path open, through the fixed restriction, that finally brings the plunger to a stand still against outside positive stops.

To return the plunger in the cylinder 311, the signal S-8 of valve 319 closes the logic valve 322, and opens the high pressure fluid flow, through the logic valve 325 to the annular area of the piston.

The high pressure fluid from logic valve 325, opens the logic valve 323, and contacts the annular area of the plunger. The high pressure fluid is conducted through the valve 321 and fixed restriction, until the retracting plunger uncovers the perforations on the cylinder wall, allowing more direct flow path to the high pressure fluid to fill the annular volume of the cylinder.

At the same time the retracting plunger is pushing the work fluid back to the accumulator 313, first through the perforations in the cylinder wall, and later when the plunger covers the holes in the cylinder wall, through the fixed restrictor while the logic valve 327 closes as a self controlled check valve, until the shuttle mechanism comes to a stand still.

To start a new cycle, the low pressure fluid from the accumulator 313 is initially conduit through the logic valve 327 to the cylinder and later when the plunger has retracted sufficiently to clear the holes in the cylinder wall, through said holes.

The high pressure pilot operating fluid in acculator 329 is isolated from the circuit pressure fluctuations with the check valve 331.

The accumulator safety unloading valve 333, signal S-33 is tied to the main control circuit, that at the shut down automatically unloads the accumulator 313.

The inker fluid motor 335 is continuously driven with the low pressure fluid through a directional flow control valve 337, and fluid flow restrictor valve 339.

The inker roll positioning lineal fluid motor 341 is operated with the directional flow control valve 343, and signal S-11 for the die plate inking, and S-12 for the ink film renovation. The operating velocity of the lineal fluid motor 341 is controlled with the fluid flow restrictor valve 345 in the return line of the direcional flow control valve 343.

The lateral fluid motors 347 and 349 of the wiper mechanism position is controlled by the signal S-13 for wiping, and S-14 of the valve 351, for retracting the wiper.

The wiper paper advancing fluid motor 353 is controlled by the signals S-18 for advancing the wiper paper, and S-17 to stop the flow through the valve 355. The speed of fluid motor 353 speed is regulated by the fluid flow restrictor valve 356 .

Normally the fluid motor 357 is held against the "back stop" by the clockwise rotation, provided by the reduced pressure fluid, supplied through the pressure reducing valve 359, check valve 361, motor 357, and check valve 363.

However, when this fluid motor is forced to rotate in counter clockwise by the pull of the paper ribbon, the motor begins to behave like a pump, receiving low pressure fluid through the pressure reducing valve 359, and check valve 361, and discharging said fluid through a counter balance valve 365 , to the tank 221.

The pressure ripples produced by the operation of the counter balance valve 365, near its almost closed position, is attenuated with a small accumulator 367 to provide some elasticity in the motor operation.

The signal S-16 of safety shut off valve 369 activates the wiper paper tensioning motor 357, while signal S-15 of valve 369 shuts off the fluid supply.

The paper transfer clamp and the paper is positioned, and locked in precise alignment with the engraving dies by the lineal fluid motor j70. A signal S-19 of valve 371 conducts the low pressure fluid to the motor to extend the aligning and locking key into engagement with the paper clamp, while signal S-20 of valve 371 retracts the aligning key, and allows a further transfer of the paper clamp.

Due to the highly important function of the clamp aligner, the working fluid supply, the accumulator 373, is separated from the fluctuations on the low fluid pressure with a check valve 375.

The accumulator 373 safety unloading valve 377, signal S-34 is tied to the main circuit control, so that at shut down, automatically unloads the accumulator 373.

The wiper paper elevator carriage with a clean roll of paper is elevated from the floor level to the top of the machine, with a high torque low-speed fluid motor 379, through a directional flow control valve 381, and 383.

The signals S-21 and S-22 to raise or lower the carriage of wiper paper, are manually operated.

The counterbalance valve 385 inhibits the possibility of the load over-riding the fluid motor, and the raising or lowering speed of the wiper paper carriage drive is controlled by the fluid flow restrictor valve 387, installed in the return line of the valve 381.

While a preferred embodiment of the present invention has been shown and described, applicants claim the benefit of a full range of equivalents within the scope of the appended claims.

We claim:

1. In an engraving press the combination comprising:
a frame;
a fixed platen supported in said frame;
upper and lower movable platens on opposite sides of and parallel to said fixed platen;
a plurality of tie rods extending through bearings in said fixed platen and secured at opposite ends to said upper and lower movable platens;
a main hydraulic cylinder rigidly supported from the underside of said fixed platen;
a piston within said cylinder;
a piston rod rigidly connecting said piston and said lower movable platen; whereby the assembly of said movable platens and tie rods may be reciprocated in a vertical plane with respect to said fixed platen;
a die plate assembly mounted for horizontal sliding movement over the upper surface of said fixed platen;
a striker assembly carried by the under surface of said upper movable platen for cooperation with a die carried by said die plate to engrave work pieces positioned therebetween; and
hydraulic means operating in timed relation with said main hydraulic cylinder for reciprocating said die plate in a horizontal plane over said upper platen between engraving, inking and wiping positions.

2. A multi-color engraving system comprising: a plurality of presses as defined by claim 1 supported adjacent each other in a straight line and a work transfer means operating in timed relation to said presses for successively positioning work pieces between the die plate and striker assembly of each press.

3. In a press as defined by claim 1, means connecting said upper and lower movable platens and tie rods comprising:
threaded ends on each tie rod;
a plurality of shouldered nuts, one threaded on each tie rod respectively;
a plurality of spacer sleeves one surrounding each tie rod end and nut respectively and extending between the shoulder of each nut and the adjacent surface of its respective movable platen; and
a plurality of plate means one overlying the end of each tie rod respectively and rigidly but removably secured to its respective movable platen.

4. In a multi-color engraving system as defined by claim 2, said work transfer means comprising:
an endless chain having parallel flights in a horizontal plane, one flight spaced outwardly of the line of presses and the other flight being adjacent the engraving position of the die plate;
spring biased work supporting clamps attached to said chain;
fluid motor drive means for indexing said chain in fixed length steps;
fluid pressure operated clamping means engagable with said chain at each press; and
means for synchronizing the indexing of said chain and the operation of said clamping means with the operation of said main hydraulic cylinder.

5. In a press as defined by claim 1 in which said hydraulic means includes a high speed linear hydraulic motor comprising:

an elongated cylinder having a plurality of radial ports adjacent each end thereof;

first and second cylinder heads, one surrounding and sealed around each end of said elongated cylinder respectively, each head having a cavity forming a sealed chamber around the radial ports of said cylinder;

a piston in said elongated cylinder having a piston rod extending through said second cylinder head and connected to reciprocate said die plate assembly;

a low pressure source connected to the cavity of said first cylinder head;

a high pressure source;

first logic valve means affording connection of said high pressure source to the cavity of said second cylinder head;

second logic valve means affording connection of said second cylinder head cavity to a fluid reservoir;

whereby when said first logic valve is closed and said second logic valve is open, said low pressure source will move said piston in said elongated cylinder towards said second cylinder head at a constant speed pushing fluid through said cylinder ports in said second cylinder head and through said second logic valve to said reservoir and at reducing speeds as said piston begins to cover said ports; and when said first valve is opened and second valve is closed, said high pressure source is connected to the rod end of said piston in said elongated cylinder causing movement towards said first cylinder head.

6. The combination of claim 5 including a first fixed orifice connected between the cavity of said first cylinder head and a pressure accummulator; and a second fixed orifice connected between the cavity of said second cylinder head and said reservoir; and first and second self piloting check valves connected in parallel with said first and second fixed orifices respectively.

7. In an engraving press as defined by claim 1, a die plate inker positioned above the path of movement of said die plate assembly;

cam means carried by opposite sides of said die plate assembly; and cam follower means carried by said inker assembly for controlling contact between said inker and said die plate.

8. An engraving press as defined by claim 7 including a die wiper assembly for removing ink from all but the engraved portions of the die plate.

* * * * *